US005267661A

United States Patent [19]

Luch et al.

[11] Patent Number: 5,267,661

[45] Date of Patent: * Dec. 7, 1993

[54] SNAP-ON, SCREW OFF CAP AND CONTAINER NECK

[75] Inventors: Daniel Luch, Los Gatos; Richard E. Repp, San Jose, both of Calif.

[73] Assignee: Portola Packaging, Inc., San Jose, Calif.

[ * ] Notice: The portion of the term of this patent subsequent to Mar. 2, 2010 has been disclaimed.

[21] Appl. No.: 830,133

[22] Filed: Jan. 31, 1992

Related U.S. Application Data

[63] Continuation-in-part of Ser. No. 772,945, Oct. 8, 1991, Pat. No. 5,213,224, which is a continuation-in-part of Ser. No. 565,638, Aug. 9, 1990, Pat. No. 5,190,178.

[51] Int. Cl.[5] ..... B65D 41/34

[52] U.S. Cl. ..... 215/256; 215/318; 215/320; 215/329; 215/354

[58] Field of Search ..... 215/252, 253, 254, 256, 215/318, 320, 329, 330, 354, 356, 357, 341; 220/296

[56] References Cited

U.S. PATENT DOCUMENTS

| | | | |
|---|---|---|---|
| 1,630,687 | 5/1927 | Aulbach | 220/296 X |
| 2,181,340 | 11/1939 | Plumb | 220/296 |
| 3,022,917 | 2/1962 | Montgomery | 220/296 X |
| 3,223,269 | 12/1965 | Williams | 215/318 |
| 3,695,475 | 10/1972 | Ruekberg | 215/318 X |
| 3,837,518 | 9/1974 | Gach | 215/256 X |
| 3,844,443 | 10/1974 | Cudzik | 220/296 |
| 3,874,540 | 4/1975 | Hidding . | |
| 3,902,621 | 9/1975 | Hidding | 215/252 |
| 3,980,195 | 9/1976 | Fillmore | 215/256 |
| 4,078,700 | 3/1978 | Hidding . | |
| 4,241,841 | 12/1980 | Boller | 215/252 |
| 4,298,129 | 11/1981 | Stull | 215/224 |
| 4,354,609 | 10/1982 | Hidding | 215/252 |
| 4,385,708 | 5/1983 | Curry | 215/256 |
| 4,448,319 | 5/1984 | Kern | 215/329 |
| 4,548,329 | 10/1985 | Curry | 215/216 |
| 4,561,553 | 12/1985 | Crisci | 215/256 |
| 4,625,875 | 12/1986 | Carr et al. | 215/232 |
| 4,744,478 | 5/1988 | Hahn | 215/252 |
| 4,796,770 | 1/1989 | Begley | 215/252 |
| 4,828,128 | 5/1989 | Tackles | 215/256 |
| 4,844,250 | 7/1989 | Holoubek et al. | 222/107 |
| 4,934,546 | 6/1990 | Markley | 215/256 |
| 4,981,230 | 1/1991 | Marshall et al. | 215/252 |
| 4,989,740 | 2/1991 | Vercillo | 215/252 |
| 5,129,538 | 7/1992 | Fuchs | 215/252 |

FOREIGN PATENT DOCUMENTS

| | | | |
|---|---|---|---|
| 812597 | 5/1969 | Canada | 215/318 |
| 1154369 | 9/1963 | Fed. Rep. of Germany | 215/252 |
| 2356007 | 2/1973 | Fed. Rep. of Germany | 215/252 |
| 2105693 | 3/1983 | United Kingdom . | |

*Primary Examiner*—Allan N. Shoap
*Assistant Examiner*—Stephen Cronin
*Attorney, Agent, or Firm*—Julian Caplan

[57] ABSTRACT

A tamper-evident, snap-on, screw-off closure is used with a specially shaped container neck. The neck has at least one first helical thread on an upper neck stretch portion, and at least one external ratchet tooth on a locking wall portion below the upper neck stretch portion. The closure has an upper skirt having at least one second helical thread mating with the first helical thread of the neck. A downward extending lower skirt portion includes an outer skirt portion and a shoulder extending inwardly from said outer skirt portion. A frangible section interconnects the shoulder and the upper skirt portion. At least one substantially vertical fin is formed upstanding from the shoulder, preventing upward deformation of the lower skirt portion without breaking the frangible section. The lower skirt portion has at least one internal ratchet tooth, and is formed with a line of weakness extending through the outer skirt portion and the shoulder. The lower skirt has a tear tab which, when pulled, fractures the lower skirt on a vertical line. Continued pulling on the tab sequentially fractures the frangible section.

26 Claims, 4 Drawing Sheets

SNAP-ON, SCREW OFF CAP AND CONTAINER NECK

CROSS-REFERENCE TO RELATED APPLICATION

This application is a continuation-in-part of co-pending U.S. application, Ser. No. 07/772,945, filed Oct. 8, 1991, now U.S. Pat. No. 5,213,224, which is a continuation-in-part of co-pending U.S. application, Ser. No. 07/565,638, filed Aug. 9, 1990, now U.S. Pat. No. 5,190,178. The disclosures of the abovementioned applications are hereby incorporated by reference.

BACKGROUND OF THE INVENTION

1. Field of the Invention

The present invention relates in general to a tamper-evident container closure and a container neck structure. More particularly, the present invention relates to a closure which is applied with an axial downward force onto the neck. After the tamper-evident feature of the invention is removed, the cap may be screwed onto and off the container as a reclosure cap.

2. Description of the Related Art

The snap-on, screw-off structures available in the prior art are of two general types—those having thread engagement as initially applied, and those without initial thread engagement. The no-thread initial engagement system has the major advantages of being simple to manufacture and apply, and achieving good reseal on reclosure through the thread torque. However, using a liner closure with this system is somewhat difficult and the consumer may be confused by the requirement of twisting the closure relative to the neck after the container is initially opened by a lifting motion. An example of a closure having no-thread initial engagement is taught by U.S. Pat. No. 4,561,553 to Crisci.

A system having full thread engagement during the initial application has several advantages over the no-thread system, including the ability to easily use lined closures and the elimination of consumer confusion. However, the initial thread engagement systems do not offer the manufacturing and application advantages available with the no-thread system. With the thread system, the closure must be twisted relative to the container at some point during the application process. An example of such a closure is shown in U.S. Pat. No. 4,625,875 to Carr.

The present invention provides full thread initial engagement by reason of a unique thread design, a unique tamper-evident band and means of orienting the closure and container threads to achieve registration prior to straight axial application. The present invention offers considerable advantages over prior structures as is evident from the description of the related art and the following description of the invention.

SUMMARY OF INVENTION

The present invention comprises an improved closure or cap and an improved neck finish. The cap skirt and neck are provided with mating threads of such shape that the cap may be applied in a simple downward vertical movement, the cap skirt and neck flexing sufficiently to permit the threads to slip past each other.

The neck finish of the present invention includes a downward extending upper neck stretch portion having at least one helical thread formed on the neck exterior. A locking wall portion is disposed below the upper neck stretch. The locking wall comprises a lower neck stretch portion offset outwardly relative to the upper neck stretch portion and a shoulder stretch portion. The shoulder stretch extends inwardly from the lower neck stretch, interconnecting the lower neck stretch and the upper neck stretch. To secure the tamper-evident closure on the container, at least one external ratchet tooth is formed on the locking wall. The ratchet teeth are located on the lower neck stretch in the preferred embodiment; however, the teeth may alternatively be positioned on the shoulder stretch.

The cap of the present invention comprises a top having a depending upper skirt having at least one helical thread formed on its inner surface. The threads of the neck and the cap are cooperatively shaped to slip past one another and interengage when the cap is pushed onto the neck. A lower skirt disposed below the upper skirt comprises a shoulder and an outer skirt portion offset outwardly from the upper skirt. The shoulder extends inwardly from the outer skirt, interconnecting the upper edge of the outer skirt and the lower edge of the upper skirt. At least one internal ratchet tooth is formed on the inner surface of the lower skirt, positioned and shaped to engage the ratchet teeth of the neck when the cap is applied to the container. In the preferred embodiment, the internal ratchet tooth is formed on the outer skirt. Alternatively, the ratchet teeth may be located on the shoulder.

The upper skirt and shoulder are connected together by a frangible section, such as a plurality of radially spaced bridges. Alternatively, a line of weakness may be formed through the cap along the intersection between the shoulder and upper skirt portion. As the closure is applied to the neck finish, the ratchet teeth on the locking wall and lower skirt interengage to prevent any twisting of the cap relative to the container. To open the container, the lower skirt must be torn from the closure, fracturing the frangible section between the shoulder and the upper skirt. The ruptured frangible section provides evidence of tampering. Thus, the lower skirt and interlocking ratchet teeth are tamper evident features of the present invention.

When opening a container, if the consumer is not concentrating on the condition of the cap, he may not notice the fractured frangible section of a previously opened container. Therefore, in the preferred embodiment the cap of the present invention further comprises means for removing the cap from the container, such as a tear tab. The lower skirt is formed with a line of weakness extending through the outer skirt and the shoulder. The tear tab is located adjacent this line of weakness. To remove the lower skirt from the closure, the consumer pulls the tab, rupturing the line of weakness and the frangible section. Tampering with the contents of the container may be detected by even the distracted consumer, since the lower skirt must be removed before opening the container.

It has been contended that the lower skirt may be curled toward the upper skirt without rupturing the frangible section, releasing the internal teeth to permit twisting of the cap relative to the container without prior removal of the lower skirt. To provide further protection against tampering, a frangible, substantially vertical fin is formed between the upper skirt and shoulder. The fin prevents upward deformation of the lower skirt and, when broken, provides further evidence of tampering. In the preferred embodiment, the fin is located adjacent the line of weakness formed through the lower skirt. Upward deformation of the lower skirt will rupture the frangible section and the line of weakness extending through the lower skirt. Thus, the vertical fin and the line of weakness are additional tamper-evident features of the present invention.

In the preferred form, the line of weakness extending through the lower skirt is a continuous stretch of material. In an alternative embodiment, a groove is formed through the shoulder and outer skirt. The shoulder is formed with a first web material bridging the groove, while the outer skirt is formed having a second web material bridging the groove. The first and second web materials are separated by a gap adjacent the intersection of the shoulder and the outer skirt. The gap between the first and second web materials increases the amount by which the lower skirt is distorted as it is curled upward, thereby facilitating the rupturing of the line of weakness.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
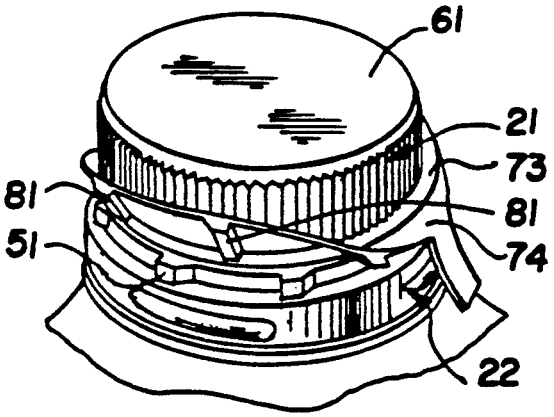
FIG. 1 is a perspective view of a cap showing possible upward deformation of the lower skirt portion relative to the cap.
Figure 3:
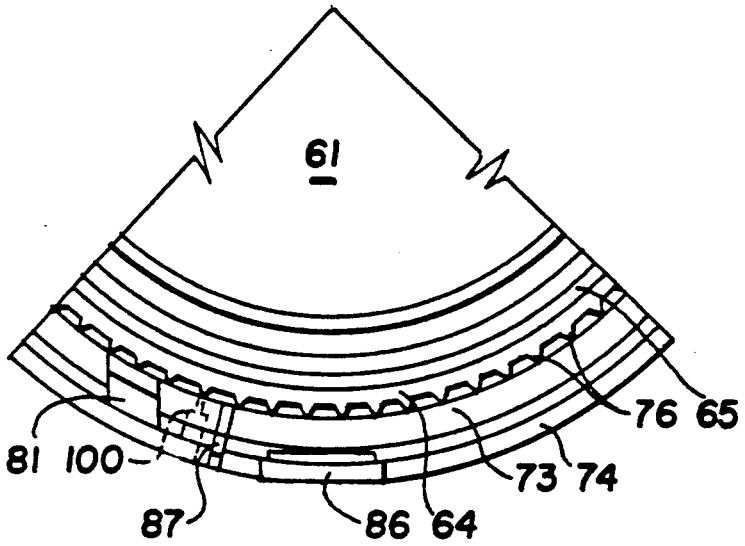
FIG. 3 is a fragmentary enlarged bottom plan of the cap.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Closure 21, hereinafter described in detail, is used with a container neck 22. The interior of the neck forms no part of the present invention. With a blow-molded bottle finish, the interior contour tends to follow that of the neck exterior. However, it will be understood that other types of bottles may be used, with the internal shape of the neck varying from that of the exterior.

Neck 22 has a central opening 23 and a downward-outward slanted lip flange 24 terminating in a vertical stretch 28. Threads 29 extend outward of stretch 28. In the illustrated embodiment, there are two threads **29*a* and 29*b*. The finish has twelve threads per inch with a double lead, each thread being six pitch and extending slightly in excess of 360° of a full thread. It is to be understood that the threads may be extended greater than 360° for increased thread engagement. Additionally, the thread leads may be of a different linear thread density (threads per inch). The upper flank 36 of thread 29 slants downwardly/outwardly at approximately 45° while the lower flank slants downwardly/inwardly at approximately 10°, permitting the threads on the interior of the cap to slip past the threads on the neck finish. Preferably, the thread apex 38** is made with as large a radius as possible.

Instead of cooperatively shaped threads on the upper neck stretch portion and the inner surface of the closure, one thread may be replaced by a groove. Further, threads 29 may be interrupted, instead of continuous.

Below the vertical stretch is downward extending locking wall portion 40. The locking wall portion has a shoulder stretch portion 42 and a lower neck stretch portion 46 offset outwardly relative to the upper neck stretch portion. In the illustrated embodiment, the lower neck portion slants downwardly/outwardly at an angle of approximately 10° and terminates in generally horizontal shoulder 47. A vertical stretch 48 depends from shoulder 47. To facilitate gripping of the container during filling and loading, vertical stretch 48 may be formed with a number of bumper ring segments 49 (here shown as four in number).

A number of ratchet teeth 51 project from lower stretch 46 on opposite sides of neck 22. Typically, three teeth 51 are formed on either side of neck 22, with the total extent of the three teeth being approximately 90°. The teeth 51 are shaped to interengage the internal ratchet teeth formed on the cap, preventing twisting of the cap relative to the neck. In the illustrated embodiment, teeth 51 are formed on lower stretch 46. However, in alternative forms of the present invention the teeth may be located on shoulder stretch 42, interengaging ratchet teeth formed on the shoulder of the cap, as is discussed below.

A cap for use with neck structure 22 is illustrated in FIGS. 2 to 7. The cap has top 61 from the periphery of which depends downward extending upper skirt 62. As illustrated, the top comprises a generally flat top disk; however, other configurations may be substituted. The upper edge of upper skirt 62 merges with slanted stretch 63, which in turn merges with upper skirt portion or vertical stretch 64. An internal shoulder 65 is formed at the intersection of stretches 62 and 63. Members 62, 63 and 64 have radially spaced vertical ribs 66 to enable the user to grip the cap.

Threads **71*a* and 71*b*, which are selected to mate with threads 29 of neck 22, are formed on the interior of the skirt. The shape of threads 29*a*, 29*b*, 71*a* and 71*b* allow the threads to slip passed one another and then interengage. Threads 71*a* and 71*b* are double lead and extend around the circumference of the cap in excess of 180 , for example, approximately 200°. In conventional capping machines, cap 21 is deposited on neck 22. Since threads 71*a*, 71*b* are diametrically opposed, the cap tends to rest horizontally on neck 22**, facilitating the application of the cap onto the neck with a downward, axial force.

The closure has ring-like skirt or lower skirt portion 70 below upper skirt portion 64. The lower skirt comprises outer skirt portion 74 offset outwardly relative to upper skirt portion 64 and a shoulder 73 extending inwardly from the upper edge of the outer skirt portion. A frangible section including a number of radially spaced bridges 76 interconnects the shoulder and the upper skirt portion. In the illustrated embodiment, the lower edges of ribs 66 form the bridges. Alternatively, a line of weakness may be formed through the intersection of shoulder 73 and upper skirt 64.

A number of internal ratchet teeth 81 spaced and dimensioned to match the teeth 51 of neck 22 are formed on outer skirt portion 74. Teeth 81 are positioned to engage teeth 51 when cap 21 is pushed onto neck 22. After cap application, the inner edges 82 of teeth 81 are positioned close to lower stretch 46. The interlocking engagement between the teeth on the cap with those on the neck prevent twisting of the cap relative to the container while the lower skirt is intact. Teeth 81 are located on the outer skirt in the present embodiment; however, the teeth may alternatively be positioned along the inner surface of shoulder 73. The teeth formed on the shoulder surface would be shaped and positioned to interengage teeth located on the shoulder stretch of neck 22. When the closure is applied to the neck, the ratchet teeth on the opposing surfaces of shoulder 73 and shoulder stretch 42 interlock, preventing removal of the cap so long as the line of weakness is not broken.

The interengagement between ratchet teeth 51 and 81 prevent twisting of the cap relative to the neck. To remove the closure, the lower skirt must first be separated from the upper skirt, as by rupturing of the frangible section, allowing the cap to be unscrewed from the container. The ruptured bridges warn the consumer that the container has been opened and the contents tampered with. Thus, the interlocking ratchet teeth and frangible bridges of the present invention are a tamper-evident features of the present invention.

In the preferred embodiment, a tear tab 86 is connected to the lower edge of outer skirt 74. The tear tab provides means for removing the lower skirt, and may be used to orient cap 21 relative to the container. Lower skirt 70 is formed with a line of weakness generally indicated by 87 extending through outer skirt 74 and shoulder 73. The line of weakness facilitates removal of the lower skirt from the closure, and is another tamper-evident feature of the present invention. When initially opening the container, the consumer pulls tab 86 to remove lower skirt 70, rupturing line 87 and frangible section 76. The absence of the lower skirt more dramatically alerts the consumer to possible tampering of the contents. A distracted consumer may fail to notice the fractured bridges, therefore the removal of the lower skirt is a more obvious indication of tampering.

It has been contended that the tamper-evident features of the closure which has been described up to this point may be circumvented by curling the lower skirt 70 in an upward direction. A cap having a partially deformed lower skirt is shown in FIG. 1. With the lower skirt completely deformed upward, teeth 51 and 81 will no longer interengage, and cap 21 may be twisted relative to the container for removal. In practice, this manipulation of the closure will usually fracture bridges 76. However, as discussed, the ruptured bridges may not be readily apparent to the distracted consumer.

To further safeguard the consumer from the dangers of tampering, a substantially vertical fin 100 is formed between upper skirt 64 and shoulder 73. In one embodiment, vertical fin 100 is located adjacent line of weakness 87, as is shown particularly in FIGS. 3, 4 and 5. When a dishonest patron attempts to curl the lower skirt 70 towards the upper skirt, the deformation of the material below the vertical fin 100, generally indicated at 102, is resisted by the fin. This resistance distorts lower skirt 70, causing line of weakness 87 and frangible bridges 76 to rupture, providing evidence of tampering. Attempts by a dishonest patron to tamper with the contents of a container by curling the lower skirt to remove cap 21 will be revealed by the fracturing of frangible section 76 and line 87. Thus, vertical fin 100 provides additional protection against tampering.

In the preferred form, fin 100 is formed with a substantially vertical line of weakness 101 through the closure adjacent the upper skirt. As lower skirt 70 is torn from the closure, line of weakness 101 is ruptured and the fin removed from upper skirt 64 together with the lower skirt. The upper skirt is provided with an even, clean finish once vertical fin 100 is removed. However, if desired, the fin could be formed with a line of weakness extending through the fin adjacent shoulder 73. The fin would then remain intact on upper skirt 64 after removal of the lower skirt from the container.

Figure 10:
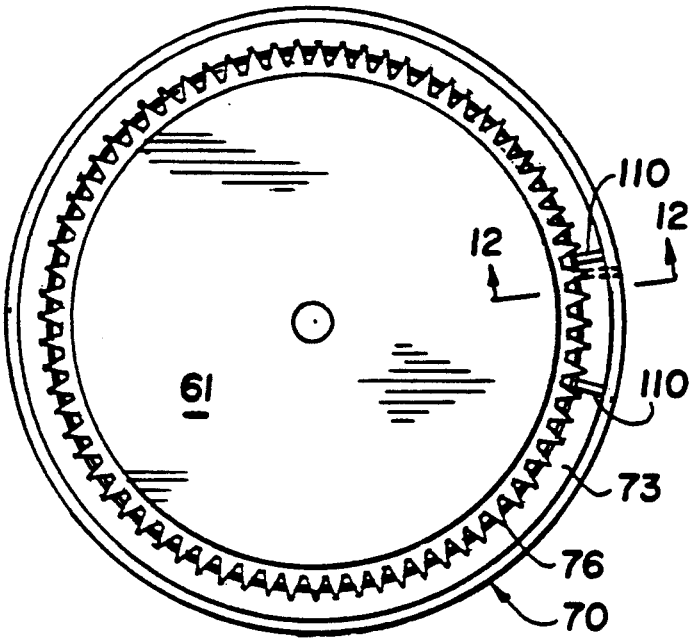
FIG. 10 is an enlarged top view of another alternative embodiment of a cap of the present invention.
Figure 11:
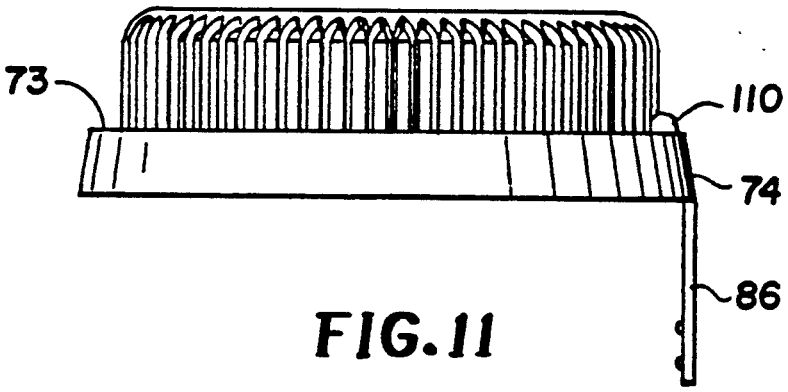
FIG. 11 is a side elevational view of the cap of FIG. 10.
Figure 12:
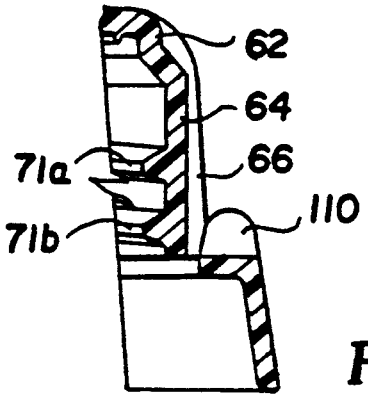
FIG. 12 is a fragmentary sectional view taken along line 12—12 of FIG. 10.

In the alternative embodiment shown in FIGS. 10–12, improved tamper evidence is achieved by a camming action of dual fins 110 upstanding from shoulder 73. In this embodiment, the fins need not be joined to upper skirt 64. If a dishonest patron attempts to curl the lower skirt to tamper with the contents of the container, dual fins 110 act as a cam to force the lower skirt radially outward, causing sufficient deformation of the lower skirt to fracture bridges 76 and line of weakness 87. A further advantage of the present embodiment is that no residual material remains on upper skirt 64 after removal of lower skirt 70.

Figure 4:
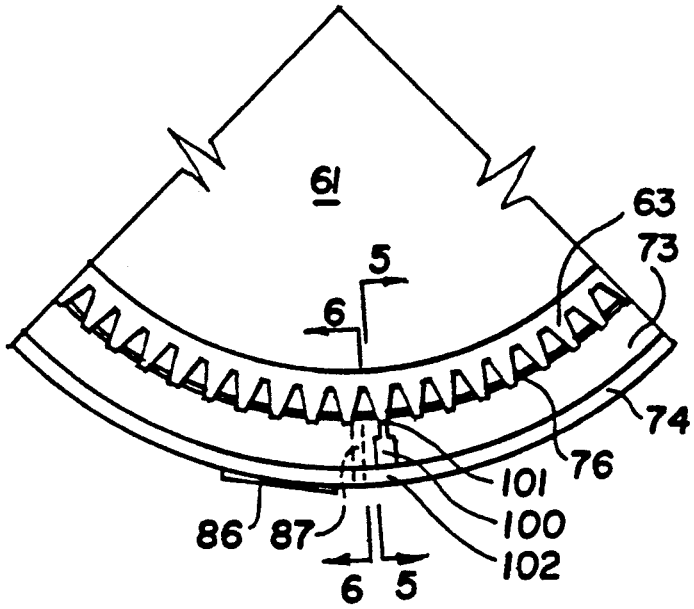
FIG. 4 is a fragmentary enlarged top plan of the cap.
Figure 2:
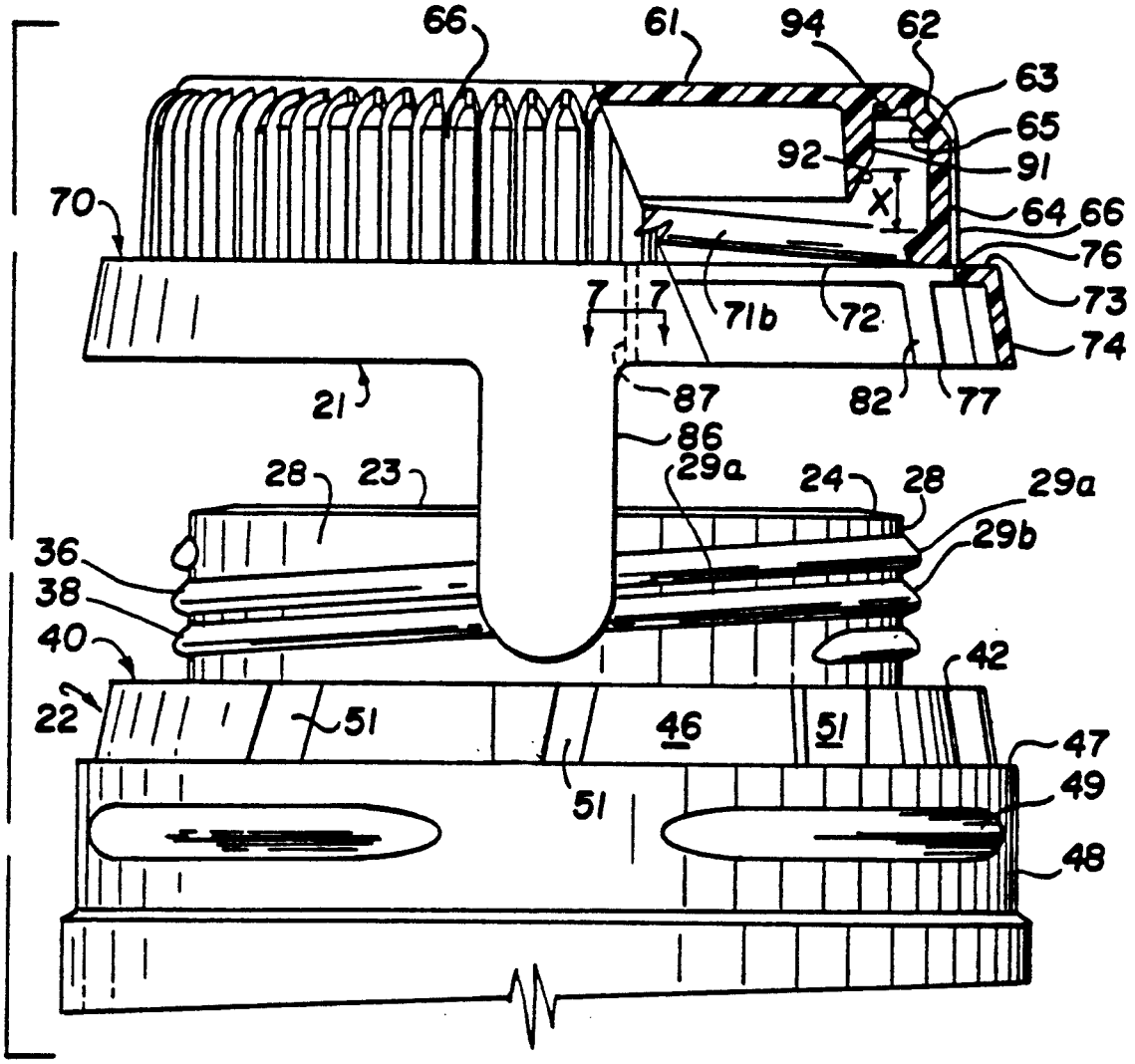
FIG. 2 is a side elevational view of a cap and neck before assembly, the cap being partially broken away in section to reveal internal construction.
Figure 5:
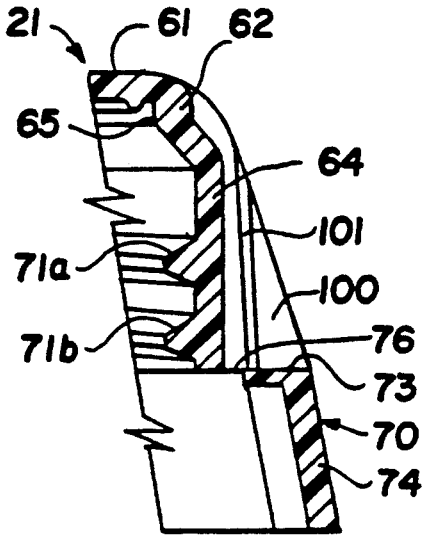
FIG. 5 and 6 are, respectively, enlarged, fragmentary sectional views taken along line 5—5 and 6—6 of FIG. 4.
Figure 6:
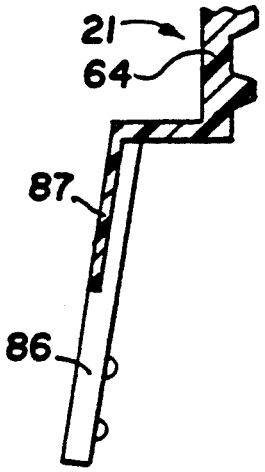
Figure 7:
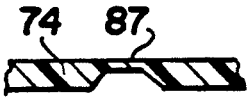
FIG. 7 is an enlarged, fragmentary sectional view taken along line 7—7 of FIG. 2, showing a preferred cross-sectional shape of a line of weakness.
Figure 8:
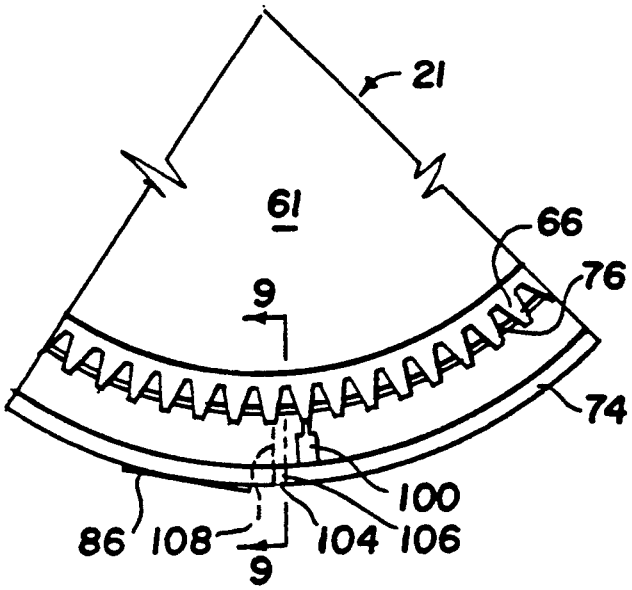
FIG. 8 is a fragmentary enlarged top plan of an alternative embodiment of a cap of the present invention.
Figure 9:
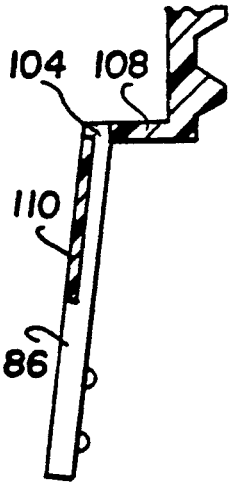
FIG. 9 is an enlarged, fragmentary sectional view taken along line 9—9 of FIG. 8.

As is illustrated particularly in FIGS. 4 and 6, line of weakness 87 extending through lower skirt 70 is a continuous section of material. This configuration is preferred as it is simple to manufacture. However, an alternative embodiment having a gap 104 at the intersection of shoulder 73 and outer skirt 74 is shown in FIGS. 8 and 9. Lower skirt 70 has a groove 106 extending through shoulder 73 and outer skirt 74. The shoulder is formed with a first web material 108 bridging groove 106, while the outer skirt is formed having a second web material 110 bridging the groove. The first and second web materials 108, 110 are separated by gap 104.

With the embodiments illustrated in FIGS. 2 to 7 and FIGS. 10 to 12, upward deformation of the lower skirt stretches the lower edge of the outer skirt, placing the corner between the shoulder and the outer skirt in compression. Removing material from the corner and forming gap 104, as in FIGS. 8 and 9, increases the amount of distortion caused by curling the lower skirt, thereby facilitating the fracturing of line of weakness 87. Thus, the alternative embodiment provides an additional tamper-evident feature of the cap of the present invention.

In feeding the snap-on screw-off closure, orientation is generally achieved by causing tear tab 86 to be at the trailing edge, riding in a slot cutout of the cap feed chute. It has been observed that occasionally the lower skirt 70 of a trailing cap will ride up onto the shoulder 73 of the preceding cap directly above the tear tab 86 of the preceding cap. This causes a jam and stops the flow of caps. It is readily apparent that an additional benefit of fin 100 and dual fins 110 of the present invention is the prevention of the occurrence of jamming.

PREFERRED OPERATION

After the container has been filled, it is transported through a capping machine. As is well understood in the bottling art, and in a manner similar to that whereby push-on, snap-off caps are applied, caps 21 are fed one at a time out of a bowl in the capping machine, with tear tab 86 orienting the caps for uniform discharge in a pre-determined orientation relative to the containers passing therebelow. Although not shown in the accompanying drawings, each container has a square cross-section or some other variation from a round shape which permits the container to be oriented relative to cap 21. The structure of capping machines is well known in the bottling art. Because of the relative orientation of cap 21 and neck 22, teeth 51 and 81 are in vertical alignment. An axially downward force is applied to the cap, pushing the cap onto the neck. Threads 71*a* and 71*b* slip over threads 29*a* and 29*b*, the slanted surfaces 36 facilitating such movement. The cap is sufficiently resilient so that it expands outward sufficiently to permit the threads to slip. As cap 21 seats on the neck, teeth 81 engage behind teeth 51 to fully engage teeth 81 in place.

After the cap has been fully seated on neck 22, it can not be removed without providing evidence of tampering. The interengagement between teeth 51 and 81 prevent unscrewing of the cap from the container, while the interengagement between the threads prevents lifting of cap 21 off neck 22. Substantially vertical fin 100 or dual fins 110 prevent upward deformation of the lower skirt without rupturing frangible bridges 76 and line of weakness 87. Thus, any attempts to tamper with the contents of the container will be revealed to the consumer.

When a consumer desires to initially open the container, he grips tab 86 and pulls circumferentially around the container causing lower skirt 70 and vertical fin 100 to be removed. Ratchet teeth 81 are thereby removed from interlocking engagement with ratchet teeth 51, providing evidence of tampering and enabling the consumer to unscrew cap 21 from neck 22. To replace the cap, the consumer merely reverses the direction of twisting.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. In combination, a container neck and a container closure, said neck having an upper opening, a downward extending upper neck stretch portion below said opening, said upper neck stretch portion having an exterior, at least one first helical engagement means around said exterior of said upper deck stretch portion, a locking wall portion below said upper neck stretch portion, said locking wall portion comprising a lower neck stretch portion offset outwardly relative to said upper neck stretch portion and a first shoulder interconnecting said upper neck stretch portion and said lower neck stretch portion, at least one external tooth on said locking wall portion, said closure having a top, a downward extending upper skirt portion depending from said top, said upper skirt portion having an interior, at least one second helical engagement means around said interior of said upper skirt portion shaped to mate with said at least one first helical engagement means, a lower skirt portion below said upper skirt portion, said lower skirt portion comprising an outer skirt portion offset relative to said upper skirt portion and a second shoulder extending inwardly from said outer skirt portion to said upper skirt portion, frangible means interconnecting said upper skirt portion and said second shoulder, at least one substantially vertical fin joined to and upstanding from said second shoulder to prevent upward deformation of said lower skirt portion without breaking said frangible means, at least one internal tooth on said lower skirt portion shaped to engage said at least one external tooth to prevent unscrewing of said closure relative to said neck without breaking said frangible means, said at least one first and second helical engagement means being shaped such that when said closure is moved directly axially downward on said neck without rotation of said closure relative to said neck, said at least one first and second helical engagement means slip past each other and then interengage.

2. The combination of claim 1 in which said at least one substantially vertical fin is joined to said upper skirt.

3. The combination of claim 2 in which said at least one substantially vertical fin is formed with a substantially vertical line of weakness extending through said at least one substantially vertical fin adjacent said upper skirt portion, whereby said at least one substantially vertical fin is a tamperevident feature of said combination.

4. The combination of claim 1 in which said frangible means comprises a plurality of radially spaced bridges.

5. The combination of claim 1 in which said at least one external tooth is located on said lower neck stretch and said at least one internal tooth is located on said outer skirt portion.

6. In combination, a container neck and a container closure, said neck having an upper opening, a downward extending upper neck stretch portion below said opening, said upper neck stretch portion having an exterior, at least one first helical engagement means around said exterior of said upper neck stretch portion, a locking wall portion below said upper neck stretch portion, said locking wall portion comprising a lower neck stretch portion offset outwardly relative to said upper neck stretch portion and a first shoulder interconnecting said upper neck stretch portion and said lower neck stretch portion, at least one external tooth on said locking wall portion, said closure having a top, a downward extending upper skirt portion depending from said top, said upper skirt portion having an interior, at least one second helical engagement means around said interior of said upper skirt portion shaped to mate with said at least one first helical engagement means, a lower skirt portion below said upper skirt portion, said lower skirt portion comprising an outer skirt portion offset relative to said upper skirt portion and a second shoulder extending inwardly from said outer skirt portion to said upper skirt portion, frangible means interconnecting said upper skirt portion and said second shoulder, at least one substantially vertical fin upstanding from said second shoulder to prevent upward deformation of said lower skirt portion without breaking said frangible means, at least one internal tooth on said lower skirt portion shaped to engage said at least one external tooth to prevent unscrewing of said closure relative to said neck without breaking said frangible means, said at least one first and second helical engagement means being shaped such that when said closure is moved directly axially downward on said neck without relative rotation of said closure and said neck, said at least one first and second helical engagement means slip past each other and then interengage.

said lower skirt portion being formed with a line of weakness extending through said second shoulder and said outer skirt portion.

7. The combination of claim 6 in which said line of weakness comprises a groove formed through aid lower skirt portion, said second shoulder formed having a first web material bridging said groove and said outer skirt portion formed having a second web material bridging said groove.

8. The combination of claim 7 in which said first and second web materials are separated by a gap adjacent the intersection of said second shoulder and said outer skirt portion.

9. The combination of claim 6 further comprising a tear tab connected to said lower skirt portion.

10. In combination, a container neck and a container closure, said neck having an upper opening, a downward extending upper neck stretch portion below said opening, said upper neck stretch portion having an exterior, at least one first helical engagement means around said exterior of said upper neck stretch portion, a locking wall portion below said upper neck stretch portion, said locking wall portion comprising a lower neck stretch portion offset outwardly relative to said upper neck stretch portion and a first shoulder interconnecting said upper neck stretch portion and said lower neck stretch portion, at least one external tooth on said locking wall portion, said closure having a top, a downward extending upper skirt portion depending from said top, said upper skirt portion having an interior, at least one second helical engagement means around said interior of said upper skirt portion shaped to mate with said at least one first helical engagement means, a lower skirt portion below said upper skirt portion, frangible means interconnecting said upper skirt portion and said lower skirt portion, a line of weakness extending through said lower skirt portion, at least one internal tooth on said lower skirt portion shaped to engage said at least one external tooth to prevent unscrewing of said closure relative to said neck without breaking said frangible means, said at least one first and second helical engagement means being shaped such that when said closure is moved directly axially downward on said neck without rotation of said closure relative to said neck said at least one first and second helical engagement means slip past each other and then interengage.

11. The combination of claim 10 in which said lower skirt portion comprises an outer skirt portion offset outwardly relative to said upper skirt portion and a second shoulder extending inwardly from said outer skirt portion to said upper skirt portion and in which said line of weakness comprises a groove formed through said lower skirt portion, said second shoulder formed having a first web material bridging said groove and said outer skirt portion formed having a second web material bridging said groove.

12. The combination of claim 11 in which said first and second web materials are separated by a gap adjacent the intersection of said second shoulder and said outer skirt portion.

13. The combination of claim 10 in which said lower skirt portion comprises an outer skirt portion offset outwardly relative to said upper skirt portion and a second shoulder extending inwardly from said outer skirt portion to said upper skirt portion and which further comprises at least one substantially vertical fin upstanding from said second shoulder to prevent upward deformation of said lower skirt portion without breaking said frangible means, whereby said at least one substantially vertical fin is a tamper-evident feature of said combination.

14. The combination of claim 13 in which said at least one substantially vertical fin is located adjacent said line of weakness.

15. The combination of claim 10 in which said at least one external tooth is located on said lower neck stretch portion and said at least one internal tooth is located on said lower skirt portion.

16. The combination of claim 10 which further comprises a tear tab connected to said lower skirt portion.

17. The combination of claim 10 in which said upper skirt is formed with external ribs having lower edges, said lower edges of said ribs comprising said frangible means.

18. A container closure for use with a container neck of the type having an upper opening, a downward extending upper neck stretch portion below said opening, said upper neck stretch portion having an exterior, at least one first helical engagement means around said exterior of said upper neck stretch portion, a locking wall portion below said upper neck stretch portion, said locking wall portion comprising a lower neck stretch portion offset outwardly relative to said upper neck stretch portion and a first shoulder extending inwardly from said lower neck stretch portion to said upper neck stretch portion, at least one external tooth on said locking wall portion, said closure having a top, a downward extending upper skirt portion depending from said top, at least one second helical engagement means around said interior of said upper skirt portion shaped to mate with said at least one first helical engagement means, a lower skirt portion below said upper skirt portion, said lower skirt portion comprising an outer skirt portion offset outwardly relative to said upper skirt portion and a second shoulder extending inwardly from said outer skirt portion to said upper skirt portion, frangible means interconnecting said upper skirt portion and said second shoulder, at least one substantially vertical fin joined to and upstanding from said second shoulder to prevent upward deformation of said lower skirt portion without breaking said frangible means, at least one internal tooth on said lower skirt portion shaped to engage said at least one external tooth to prevent unscrewing of said closure relative to said neck without breaking said frangible means, said at least one first helical engagement means and said at least one second helical engagement means being shaped such that when said closure is moved directly axially downward on said neck without rotation of said closure relative to said neck, said at least one first helical engagement means and said at least one second helical engagement means slip past each other and then interengage.

19. The closure of claim 18 in which said substantially vertical fin is joined to said upper skirt portion.

20. The closure of claim 19 in which said at least one substantially vertical fin is formed with a substantially vertical line of weakness extending through said at least one substantially vertical fin adjacent said upper skirt portion, whereby said at least one substantially vertical fin is a tamperevident feature of said closure.

21. The closure of claim 18 in which said at least one internal tooth is located on said outer skirt portion.

22. The closure of claim 18 in which said at least one substantially vertical fin is spaced from said upper skirt portion.

23. A container closure for use with a container neck of the type having an upper opening, a downward extending upper neck stretch portion below said opening, said upper neck stretch portion having an exterior, at least one first helical engagement means around said exterior of said upper neck stretch portion, a locking wall portion below said upper neck stretch portion, said locking wall portion comprising a lower neck stretch portion offset outwardly relative to said upper neck stretch portion and a first shoulder extending inwardly from said lower neck stretch portion said upper neck stretch portion, at least one external tooth on said locking wall portion, said closure having a top, a downward extending upper skirt portion depending from said top, said upper skirt portion having an interior, at least one second helical engagement means around said interior of said upper skirt portion shaped to mate with said at least one first helical engagement means, a lower skirt portion below said upper skirt portion, said lower skirt portion comprising an outer skirt portion offset outwardly relative to said upper skirt portion and a second shoulder extending inwardly from said outer skirt portion to said upper skirt portion, frangible means interconnecting said upper skirt portion and said second shoulder, at least one substantially upstanding from said second shoulder to prevent upward deformation of said lower skirt portion without breaking said frangible means, at least one internal tooth on said lower skirt portion shaped to engage said at least one external tooth to prevent unscrewing of said closure relative to said neck without breaking said frangible means, said at least one first helical engagement means and said at least one second helical engagement means being shaped such that when said closure is moved directly axially downward on said neck without relative rotation of said closure and said neck, said at least one first helical engagement means and said at least one second helical engagement means slip passes each other and then interengage, said second shoulder and said outer skirt portion are formed with a line of weakness extending through said second shoulder and said outer skirt portion.

24. The closure of claim 23 in which said at least one substantially vertical fin is located adjacent said line of weakness.

25. The closure of claim 23 in which said line of weakness comprises a groove formed through said second shoulder and said outer skirt portion, said second shoulder formed having a first web material bridging said groove and said outer skirt portion formed having a second web material bridging said groove.

26. The closure of claim 26 in which said first and second web materials are separated by a gap adjacent the intersection of said second shoulder and said outer skirt portion.

* * * * *